US010407854B2

(12) United States Patent
Bessette et al.

(10) Patent No.: US 10,407,854 B2
(45) Date of Patent: Sep. 10, 2019

(54) JOINT SAWING SYSTEM FOR CONCRETE BARRIERS

(71) Applicant: GROUPE CRH CANADA INC., Quebec (CA)

(72) Inventors: Robert Bessette, Quebec (CA); Yan Boucher, Quebec (CA)

(73) Assignee: GROUPE CRH CANADA INC., Quebec (CA)

( * ) Notice: Subject to any disclaimer, the term of this patent is extended or adjusted under 35 U.S.C. 154(b) by 126 days.

(21) Appl. No.: 15/594,089

(22) Filed: May 12, 2017

(65) Prior Publication Data

US 2018/0326616 A1 Nov. 15, 2018

(51) Int. Cl.

| | |
|---|---|
| ***B28D 1/04*** | (2006.01) |
| ***B24B 19/00*** | (2006.01) |
| ***E01C 23/09*** | (2006.01) |
| ***E01F 15/08*** | (2006.01) |

(52) U.S. Cl.

CPC ..... *E01F 15/083* (2013.01); *B24B 19/004* (2013.01); *B28D 1/042* (2013.01); *B28D 1/045* (2013.01); *E01C 23/0933* (2013.01)

(58) Field of Classification Search

CPC ..... B24B 19/004; B28D 1/04; B28D 1/042; B28D 1/045; E01C 23/094; E01C 23/0933; Y10S 83/928

See application file for complete search history.

(56) References Cited

U.S. PATENT DOCUMENTS

| | | | | | |
|---|---|---|---|---|---|
| 470,779 | A * | 3/1892 | Calef | B23D 49/14 | 30/166.3 |
| 2,081,360 | A * | 5/1937 | Mall | B23D 45/006 | 451/429 |
| 2,214,141 | A * | 9/1940 | Mall | E01B 31/04 | 451/429 |
| 2,726,652 | A * | 12/1955 | Brittain | B28D 1/042 | 125/13.03 |
| 2,819,709 | A * | 1/1958 | MacGregor | B28D 1/042 | 125/13.03 |
| 3,340,863 | A * | 9/1967 | Zuzelo | B28D 1/042 | 125/14 |
| 4,068,415 | A * | 1/1978 | McIlrath | B23D 45/006 | 451/347 |
| 4,357,120 | A * | 11/1982 | MacDonald | E01C 23/094 | 144/34.1 |
| 4,765,098 | A * | 8/1988 | Duff | B23D 45/003 | 451/236 |

(Continued)

FOREIGN PATENT DOCUMENTS

EP 2561968 6/2015

*Primary Examiner* — Timothy V Eley

(74) *Attorney, Agent, or Firm* — Banner & Witcoff, Ltd.

(57) ABSTRACT

A system and a method for sawing control joints in concrete barriers is provided. The system includes a barrier mounting frame slidably mountable about the barrier, on the top, first and second lateral faces of the barrier. The system also includes a saw attachment having a circular saw attached thereto, the circular saw being manually operable. A linkage assembly connects the frame mounting barrier to the saw attachment, and allows to manually move the circular saw up or down, and towards or away from the barrier, when in use, to create the control joint transversally along the top, first and second lateral faces of the barrier.

22 Claims, 6 Drawing Sheets

(56) References Cited

U.S. PATENT DOCUMENTS

| | | | | |
|---|---|---|---|---|
| 5,230,270 | A | 7/1993 | Bertrand | |
| 5,486,136 | A * | 1/1996 | Noda | B23D 45/006 451/347 |
| 5,540,210 | A * | 7/1996 | Jones | B23D 45/16 125/13.01 |
| 5,545,079 | A * | 8/1996 | Larsson | B23D 45/006 125/13.01 |
| 5,784,994 | A * | 7/1998 | van der Lely | A01J 5/0175 119/14.08 |
| 6,234,889 | B1 * | 5/2001 | Huboud Peron | B23D 45/006 125/12 |
| 6,314,853 | B1 * | 11/2001 | Omi | B23D 45/006 451/347 |
| 8,931,853 | B1 | 1/2015 | Taylor, Jr. | |
| 9,708,777 | B2 * | 7/2017 | Weatherill | B24B 19/004 |

* cited by examiner

JOINT SAWING SYSTEM FOR CONCRETE BARRIERS

TECHNICAL FIELD

The present invention relates to sawing systems for cutting concrete. More specifically, the invention is directed to a sawing system for cutting joints in concrete barriers, such as Jersey barriers.

BACKGROUND

Concrete barriers are used on the sides of roads and highways, to protect cars in case of accidents. They are also used to separate lanes in traffic. These barriers typically have a flared or funnel shape, with the base being larger than the upper part. They may be symmetrical or not, with only one of the lateral sides being wider at the base and the other lateral side being straight. Concrete barriers come in different shapes and sizes, and can be referred to as Jersey barriers, Texas barriers, K-rails, F-barriers, tall walls or step barriers. They can also be modular or continuous. In the latter case, the concrete barriers are slipformed on site, that is, the barriers are made from drycast concrete that is extruded with specialized machinery to form the barriers directly at the location where they are intended to be used.

For concrete barriers that extend over long distances, such as slipformed concrete barriers, crack control joints are usually sawed in the barrier at predetermined intervals. These joints ensure that horizontal/longitudinal cracking, that may eventually occur in the barrier, will be controlled and stopped at the joints. Currently, road workers cut these control joints in the concrete barriers using hand held circular saw, which can be a difficult and dangerous task. In addition, this method requires workers to wear cumbersome protective gear, such as breast plates and shin guards, which are often uncomfortable and difficult to move in.

There have been attempts to alleviate the task of cutting joints in concrete barriers for construction workers. An example of such system is described in U.S. Pat. No. 5,230,270. The system proposed in this patent is highly impractical since it requires a vehicle for transporting the machinery.

There is still a need for improved systems and methods for cutting joints in concrete barriers.

SUMMARY

According to a first aspect, a system for sawing a control joint in a concrete barrier is provided. The barrier has a top face and opposed first and second lateral faces. The system comprises a barrier mounting frame slidably mountable about the barrier, on the top, the first and the second lateral faces of the barrier. The system also includes a saw attachment having a circular saw attached thereto, the circular saw being manually operable. The system also includes a linkage assembly connecting the frame mounting barrier to the saw attachment, the linkage assembly allowing to manually move the circular saw up or down, and towards or away from the barrier, when in use, to create the control joint transversally along the top, first and second lateral faces of the barrier.

According to another aspect, a system for creating crack control joints in concrete barriers is provided. The system comprises a barrier mounting frame mountable about the barrier, on the top and lateral faces of the barrier. The barrier mounting frame comprises wheels to move the system along the barrier. The system also includes a first linkage sub-assembly pivotable relative to the barrier mounting frame, the first linkage assembly being movable between raised and lowered positions. The system also includes a second linkage sub-assembly pivotable relative to the first linkage sub-assembly and being movable between contracted and retracted positions. The system also includes a saw attachment provided at a lower end of the second linkage assembly, the saw attachment having a circular saw attachable thereto, to saw the crack control joints transversally on the top and lateral faces of the concrete barrier.

Preferably, the first and second linkage sub-assemblies form respective first and second four-bar or parallelogram linkages, operatively coupled to one another. Still preferably, the system comprises a dampening mechanism to dampen motion of the circular saw. Still preferably, the system comprises a biasing mechanism to support a weight of the circular saw. Still preferably, the system is configurable between first and second configurations, wherein in the first configuration, the circular saw faces a first side of the concrete barrier, and in the second configuration, the circular saw faces a second side of the concrete barrier.

According to yet another aspect, a method of sawing control joints in a concrete barrier is provided. The method comprises the steps of slidably mounting a system for sawing joints about the barrier, on the top, first and second lateral faces of the barrier. The system comprises a linkage assembly supporting and guiding a circular saw, the linkage assembly allowing to raise or lower the circular saw relative to the barrier, and to bring the circular saw toward or away from the barrier. The method comprises a step of manually moving the circular saw about the barrier to create a control joint that extends transversally along the first, the top and the second lateral faces of the barrier.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, similar features in different embodiments have been given similar reference numbers. For the sake of simplicity and clarity, namely so as to not unduly burden the figures with unneeded references numbers, not all figures contain references to all the components and features; references to some components and features may be found in only one figure, and components and features of the present disclosure which are illustrated in other figures can be easily inferred therefrom.

With reference to FIGS. 1 to 6, a possible embodiment of a system for sawing control joints in concrete barriers will be described. The system can be used to create crack control joints in any type of concrete barriers. The system is an improvement over existing apparatuses and methods, since it does not require the use of a vehicle or complex/onerous system to operate or transport it along the barrier. The present system is also safer and less difficult than the traditional method for creating control joints in North America, i.e. by having road workers manually operate a circular saw, without any guide and by manually supporting the entire weight of the saw.

Figure 1:
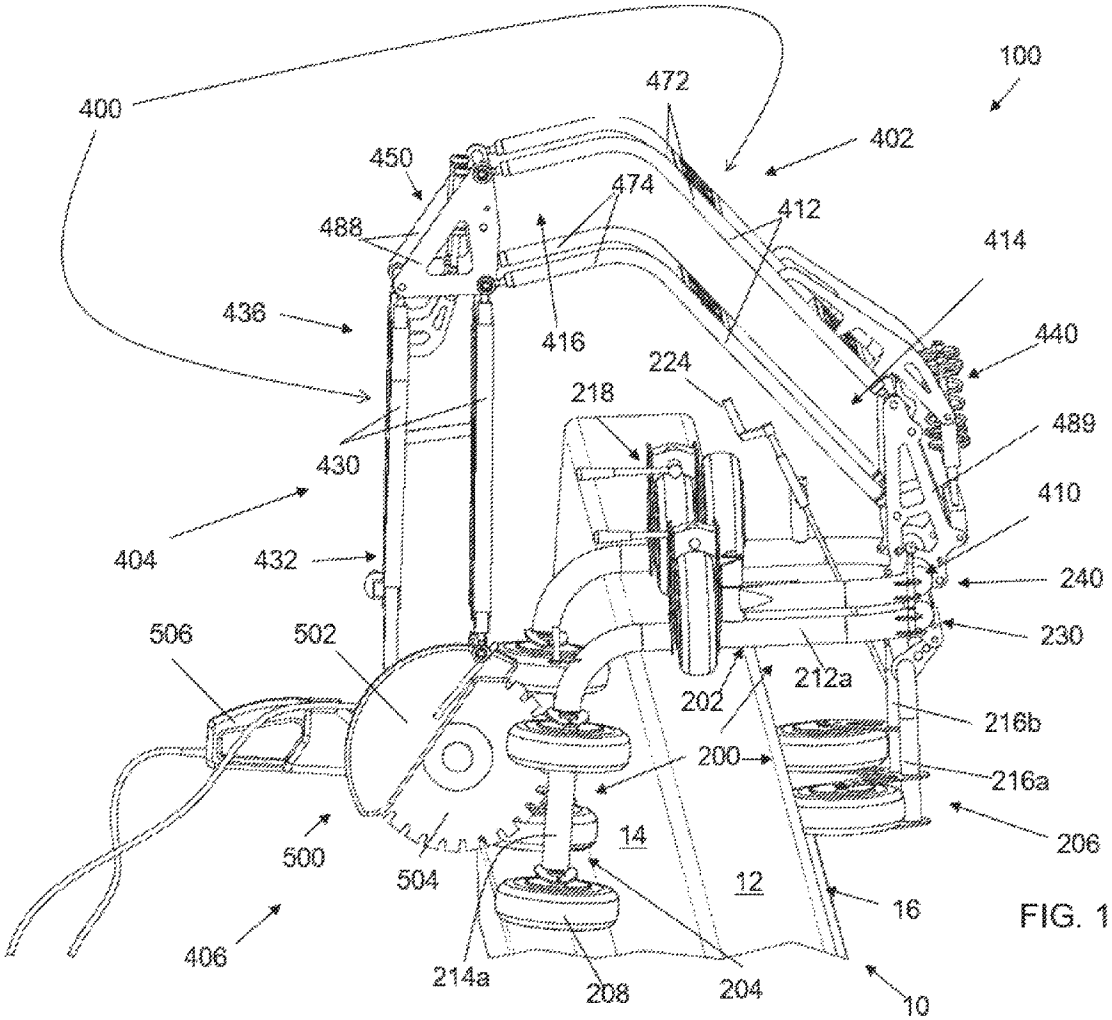
FIG. 1 is a side view of the system for sawing control joints, according to a possible embodiment.

Referring to FIG. 1, the system 100 is shown mounted on a concrete barrier 10 of the Jersey type, which has been previously slipformed and dried. The concrete barrier 10 shown is a Jersey barrier, but the system 100 can be used with any type of concrete barrier that has a top face 12, and opposed first and second lateral faces 14, 16. The barrier 10 shown in the Figures has a flared shape, but the system 10 can be used with straight-side barriers, and/or with barriers being much higher than the one shown in the Figures. The system 100 includes a barrier mounting frame 200, a linkage assembly 400 and a saw attachment 300 (identified in FIG. 2), for attaching a circular saw 500.

The barrier mounting frame 200 is the part of the system that can move or slide along the barrier 10, and which supports the linkage assembly 400 and the circular saw 500. The barrier mounting frame 200 is slidably mountable about the barrier 10, preferably on the three faces or sides of the barrier, that is on the top and lateral faces 12, 14, 16. The barrier mounting frame 200 is made of a plurality of framing elements provided with sliding means—in this case wheels—so as to slide or glide along the barrier 10. In the present embodiment, the barrier mounting frame 200 has first and second lateral sections 204, 206, sized, shaped and configurated to rest against the first and second lateral faces 14, 16 of the barrier 10. The barrier mounting frame also has a top section 202, provided between the first and second lateral sections 204, 206, sized, shaped and configured to rest on the top face 12 of the barrier 10. Preferably, each of the sections 202, 204, 206 comprises one or more free wheels 208, allowing the barrier mounting frame 200—and thus the system 100—to roll along the barrier 10. Pneumatic free wheels are preferred, since the system 10 is designed to be manipulated by single workman, that can simply manually push the system 100 along the barrier, between locations where control joints are to be made. Since the movement along the system 100 is made by manually pushing the frame 200 along the barrier 10, operating the system 100 is simple as it does not require electrical power to actuate it, and power is only needed to operate the circular saw 500. As such, the barrier mounting frame 200 preferably does not include any electrical components, and does not need to be removed from the barrier and stored between working shifts, as it is less likely to be affected by rain or humidity.

Figure 2:
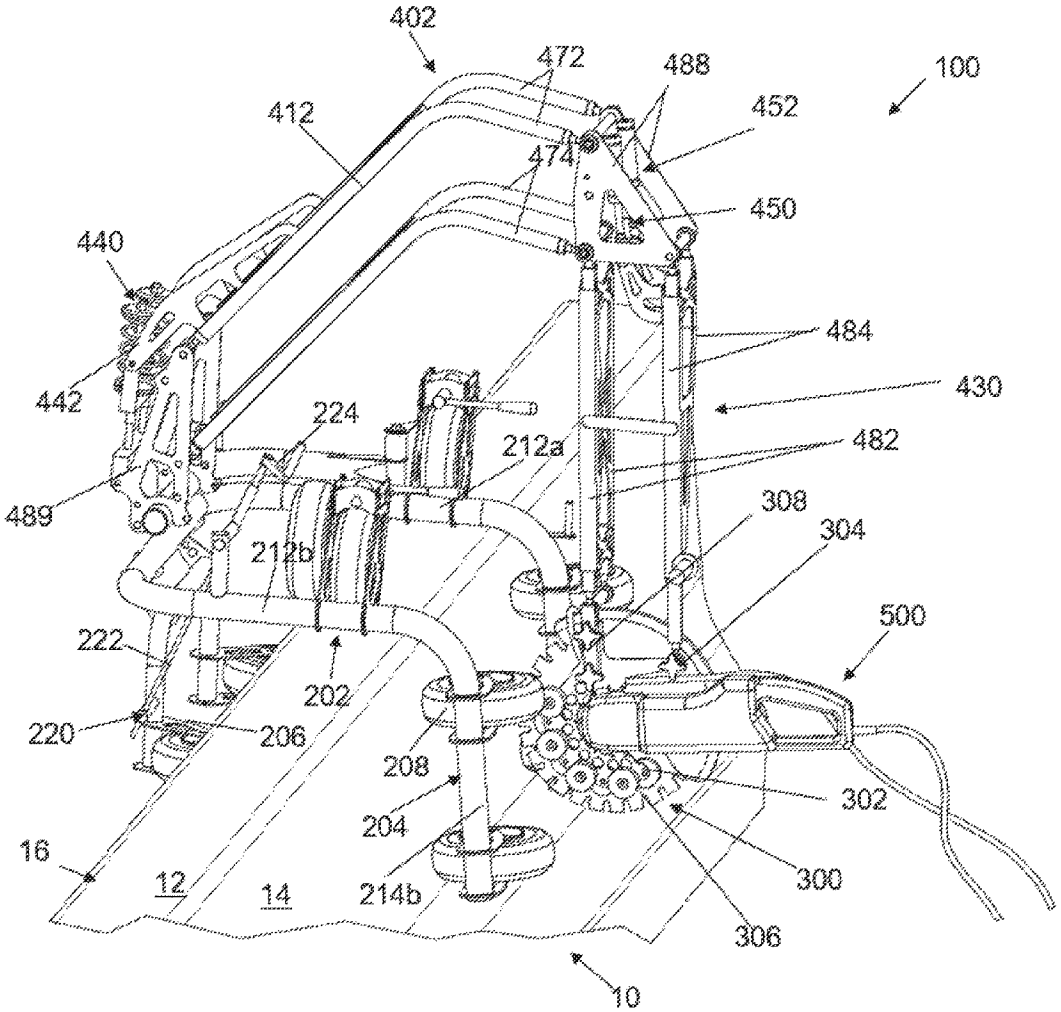
FIG. 2 is a side view of the system of FIG. 1, shown from the other side.

Still referring to FIG. 1, and also to FIG. 2, in the present embodiment, each section 202, 204, 206 of the barrier mounting frame 200 includes at least two framing elements spaced apart, and preferably parallel to one another. The framing elements provide rigidity and stability to the system 100. The top section 202 includes framing elements 212*a*, 212*b*, the first lateral section 204 includes framing elements 214*a*, 214*b* and the second lateral section includes framing elements 216*a*, 216*b*. Of course, the barrier mounting frame 200 can include additional framing elements, as is the case in the present embodiment. The framing elements are preferably made of metal. In the present case, the framing elements are made of metallic hollow tubes, which are rigid enough to support the other components of the system 100, while providing the system with a light/unobstructive base. In this embodiment, the framing elements 214*a*, 212*a*, 212*b*, 214*b* are made of a hollow metallic tube having a U-shape, with legs being bent to form the top and first lateral sections 202, 204. The second lateral section 206 is also made of a U-shaped hollow metallic tube, the legs of the U-shape tube forming the framing elements 216*a*, 216*b*. Of course, other configurations and arrangements of the framing elements for the barrier mounting frame are possible, without departing from the present invention. Preferably, each framing element 212*a*, 212*b*, 214*a*, 214*b*, 216*a*, 216*b* is provided with at least one of said free wheels, the free wheels being in contact with the faces of the barrier when the barrier mounting frame 200 is mounted about the barrier 10. Still preferably, at least one of the lateral side sections is provided with two wheels attached to its framing elements 214*a*, 214*b*. The wheels of the lateral sections 204, 206 are mounted so as to have their wheel axis oriented vertically when in use, and the wheels of the top section 202 have their wheel axis extending transversally relative to the barrier 10.

A brake 218 can be provided on at least one of the wheels 208, to block the wheel and prevent the barrier mounting frame 200 from sliding on the barrier. The brake is preferably manually operated, and the wheels can be blocked or unblocked, depending on whether the system is to be moved between joints, or the saw is in use. In the present case, each of the top wheels 208 are provided with a manual brake, which can be manually activated with a lever that clamps the wheel and blocks it when moved in a blocking position. Optionally, a spare wheel 210 can be provided on the barrier mounting frame 200.

Given that the width of the concrete barriers can differ from one type to another, the system 100 is preferably provided with an adjustment mechanism 220 that can adjust or modify—for example increase or decrease—the spacing between the lateral sections 204, 206 of the barrier mounting frame 200, according to the width of the barrier 10. In the present embodiment, the adjustment mechanism 220 rotates the framing elements 216*a*, 216*b* of the second lateral section 206, which in turn causes their respective wheels to move towards or away from the first lateral section 204. The distance between the innermost surfaces of the wheels 208 of the first and second lateral sections 204, 206, can therefore be adjusted to correspond to the width of the upper portion of the concrete barrier 10. In the present case, the adjustment mechanism includes a rod 222 rigidly connected to one of the framing elements 216*a*, 216*b*. The rod 222 is preferably threaded, and is operatively connected to one of the wheels, and the rotation of the rod moves the wheel towards or away from the lateral face of the barrier, when the system is mounted on the barrier, as best shown in FIG. 2. Preferably, a handle 224 is provided at the upper end of the rod, allowing workers to more easily rotate the rod 222 to adjust the distance between the two lateral sections 204, 206. Other adjustment mechanisms are possible, but what is needed is for the mechanism 220 to adjust the clamping distance between the lateral sections of the barrier mounting frame 200, so as be mountable about concrete barriers of different widths.

Still referring to FIGS. 1 and 2, and also to FIG. 3, the linkage assembly 400 will be described. The linkage assembly 400 comprises one or more articulations and sub-assemblies that support the weight of the circular saw 500 and allow manually moving or guiding the circular saw 500 along a plane that is traversal relative to the barrier. In other words, the linkage assembly 400 allows a worker operating the system 100 to move the saw 500 vertically, or up and down, and transversally, i.e. along the width of the barrier, when the system 100 is mounted on the barrier 10. The linkage assembly can include different linking elements and connecting plates, as will described in more detail below. More specifically, the linkage assembly 400 includes at least a first linkage sub-assembly 402 and a second linkage sub-assembly 404.

Figure 6:
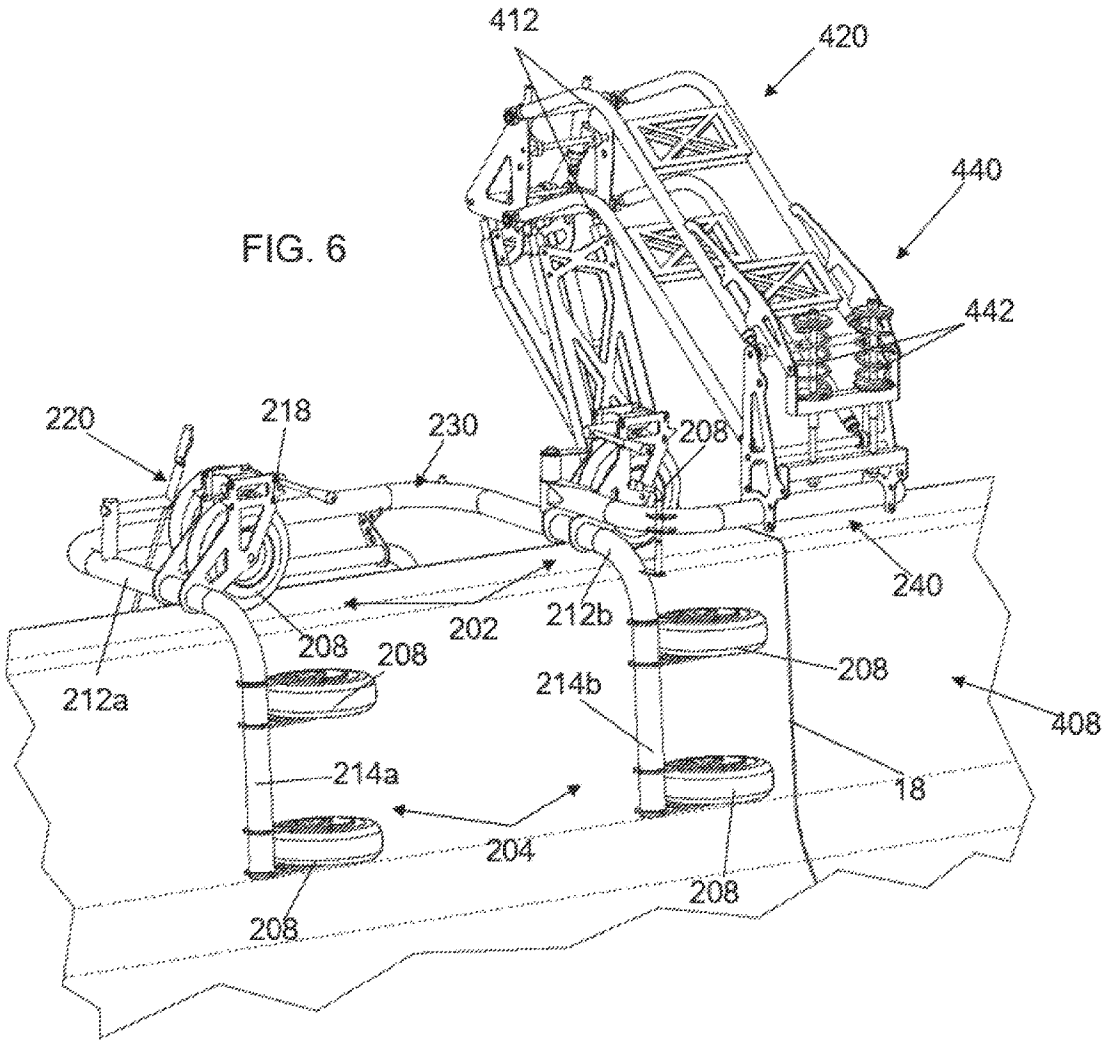
FIG. 6 is a different perspective view of the system of FIG. 1, shown in the second configuration.

The first linkage sub-assembly is pivotally connected to the barrier mounting frame 200, and allows raising and lowering the circular saw 500 relative to the barrier mounting frame 200, and thus relative to the barrier 10, when in use. The first linkage sub-assembly 402 comprises a boom 412, which in the present case comprises of pairs of lower and upper boom links 472, 474. The first linkage sub-assembly preferably forms a first parallelogram, or four-bar linkage. The first linkage sub-assembly can therefore rock upwardly and downwardly relative to the barrier mounting frame 200. The upper and lower boom links forms two of the links, and may be referred as input and output links, and the plates 488 and 489 forms the remaining two links. The boom-frame connecting plates 489 are preferably fixed relative to the barrier mounting frame 200, forming a fixed link. The boom-support plates 488 may be referred as a floating assembly or link. The boom links are preferably metallic hollow tubes, bent at an angle close to 90 degrees at their top ends. The boom 412 has a lower boom end 414 and an upper boom end 416, the lower end 414 being able to pivot relative to the barrier mounting frame 200. The lower end 414 can also be referred as an inner end, and the upper end 416 as an outer or distal end. Of course, in the lowered position, such as shown in FIG. 6, the upper end 416 can be positioned lower than the lower end 414. The boom 412 pivots about a first axis which is parallel to the length of the barrier. The boom 412 can thus move between a lowered position 420, such as shown in FIG. 6, and a raised position 418, as shown in FIG. 3. The boom 412 shown in FIGS. 1 and 2 is positioned between the lowered and raised positions. The two boom links of a single pair are spaced apart by spacing plates or brackets 476. The first linkage sub-assembly 402 also comprises a set of plates 489 and links to pivotally connect the boom 412 to the barrier mounting frame 200, preferably on the top section of the barrier mounting frame 200. The boom 412, and thus the boom links 472, 474 preferably have an L-shape, the shorter portion of the L substantially facing the top face of the barrier 10 when the first linkage sub-assembly 402 is in the raised position 418, as shown in FIG. 3.

The second linkage sub-assembly 404 is pivotally connected to the first linkage sub-assembly 402, and allows moving the circular saw 500 towards or away from the barrier mounting assembly 200, and thus relative to barrier 10, when in use. Similar to the first linkage sub-assembly, the second linkage sub-assembly also preferably forms a parallelogram, or four-bar linkage. The second linkage sub-assembly 404 can rock relative to the first linkage sub-assembly 402. As best shown in FIGS. 2 and 3, the second linkage sub-assembly 404 includes inner and outer links 482 and 484, pivotally connected to the boom-support connecting plates 488 at one end, and pivotally connected the saw attachment 300 at the other end, thus forming the parallelogram. The second linkage sub-assembly 404 comprises a saw support 430, formed by the links 483, 484, and having an upper support end 434 and a lower support end 432. The saw support 430 can thus pivot about a second axis which is also parallel to the length of the barrier 10. The upper support end 434 can pivot relative to the upper boom end 416 and the saw attachment 300 is connected or provided at the lower support end 432 of the saw support 430. The saw support 430 can thus move between a retracted position, in which the saw 500 is positioned away from the barrier mounting frame 200—and thus away from the barrier 10, to a contracted position, in which the saw 500 is positioned closed to the barrier mounting frame 200 and barrier 10. For this particular embodiment, similar to the first linkage sub-assembly 402, the second linkage sub-assembly comprises pairs of inner support links 482 and outer support links 484. The upper support end 434 and the upper boom end 416 are pivotally connected to boom-support connecting plates 488, which, in the illustrated embodiment, are triangular in shape. Extremities of the links 472, 474, 482, 484 are pivotally attached to vertices of the connecting plates 488. Of course, other possible configurations and arrangements are possible for the first and second linkage sub-assemblies 402, 404. In this preferred embodiment, the linkage assembly 400 comprises two four-bar linkage sub-assemblies 402, 404, coupled via the junction plates 488, with the first sub-assembly being fixedly connected at one end to the barrier mounting frame 200. The sub-assemblies can include more or fewer links, and more or fewer connecting plates, and different pivot points. It is also possible for the linkage assembly 400 to include more than two sub-assemblies, as long as the linkage assembly 400 allows moving the circular saw with at least two degrees of freedom. As can be appreciated, the linkage assembly 400 is preferably entirely mechanical, and does not require a motor or drive to actuate it.

As best shown in FIGS. 1 and 6, in order to support the weight of the circular saw 500, the system 100 preferably includes a biasing mechanism 440 that biases or urges the boom 412 upwardly. The biasing mechanism 440 is preferably provided proximate the lower boom end 414 of the first linkage sub-assembly 402. In the present case, the biasing mechanism 440 is disposed between to the barrier mounting frame 200 and the lower boom end 414, and comprises two compression springs 442 which are in a resting position when no force is applied on the circular saw 500. When a worker lowers the circular saw toward the lowered position, the springs 442 are compressed and when the worker raises the circular saw past the "rest" positon, toward the raised position, the springs 442 are extended. The stiffness of the springs is thus chosen for the linkage assembly 400 to support the weight of the circular saw 500 and bias the saw in a rest position. While in the illustrated embodiments, the biasing mechanism 440 comprises springs, other biasing elements are possible, such as pneumatic or hydraulic cylinders, or elastic bands.

Figure 3:
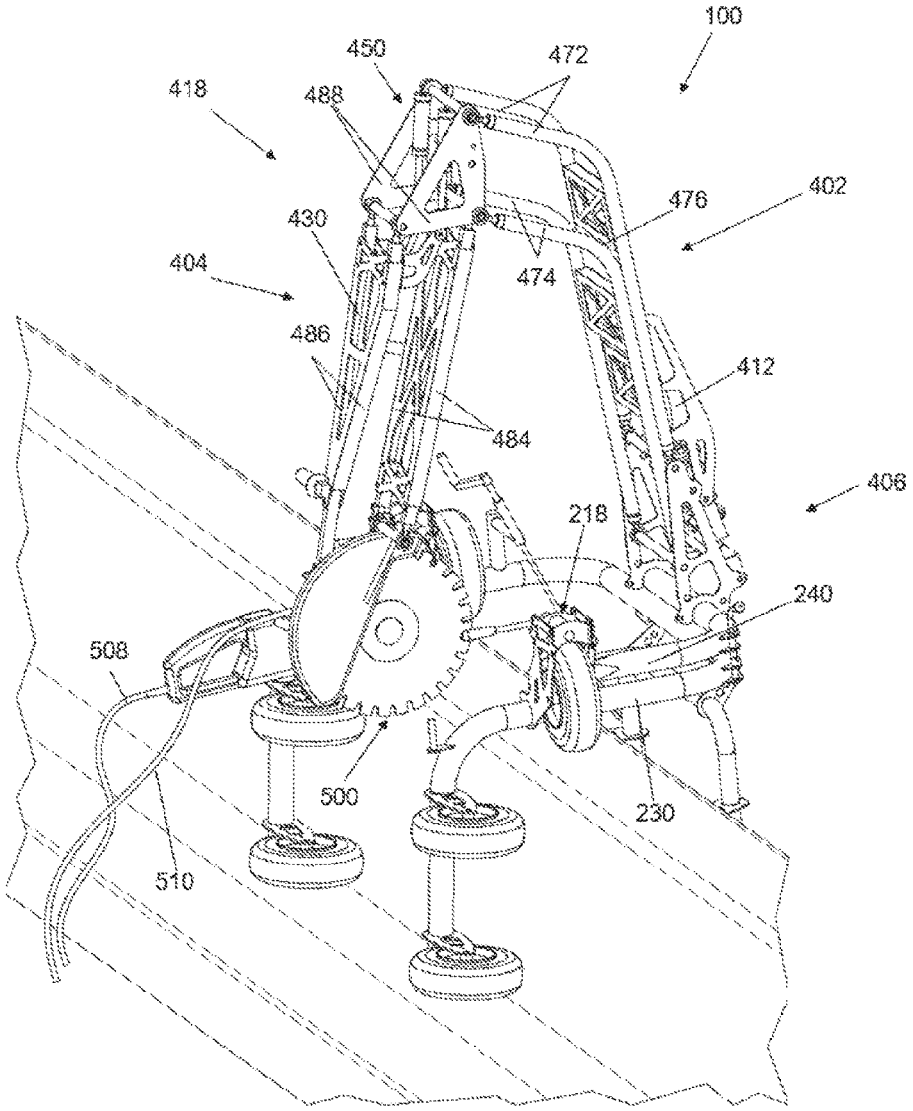
FIG. 3 is a perspective view of the system of FIG. 1, shown in a first configuration.

Referring now to FIGS. 2 and 3, the system 100 also preferably includes a dampening mechanism 450 to dampen the motion of the circular saw 500 when moved between the retracted and contracted positions and/or to absorb the torque from the circular saw 500. The dampening mechanism 450 is preferably provided between the saw support 430 and the boom 412. In the present case, the dampening mechanism 450 comprises a pair of shock absorbers or shock dampers 452, which are preferably operatively connected to the upper support end 434 and to the connected plates 488. Other dampening components can be used, such as springs or rubber bands, for example. The dampening mechanism 450 can also be referred to as an "anti-kickback" system, which allows limiting incidents related to the manipulation of the circular saw. In cases where a worker would suddenly unintentionally release or drop the saw, the damping mechanism will dampen and slow down the motion of the linkage assembly 400 and thus of the circular saw 500. The damping mechanism also prevents or limits a kickback motion of the circular saw when in operation.

Figure 4:
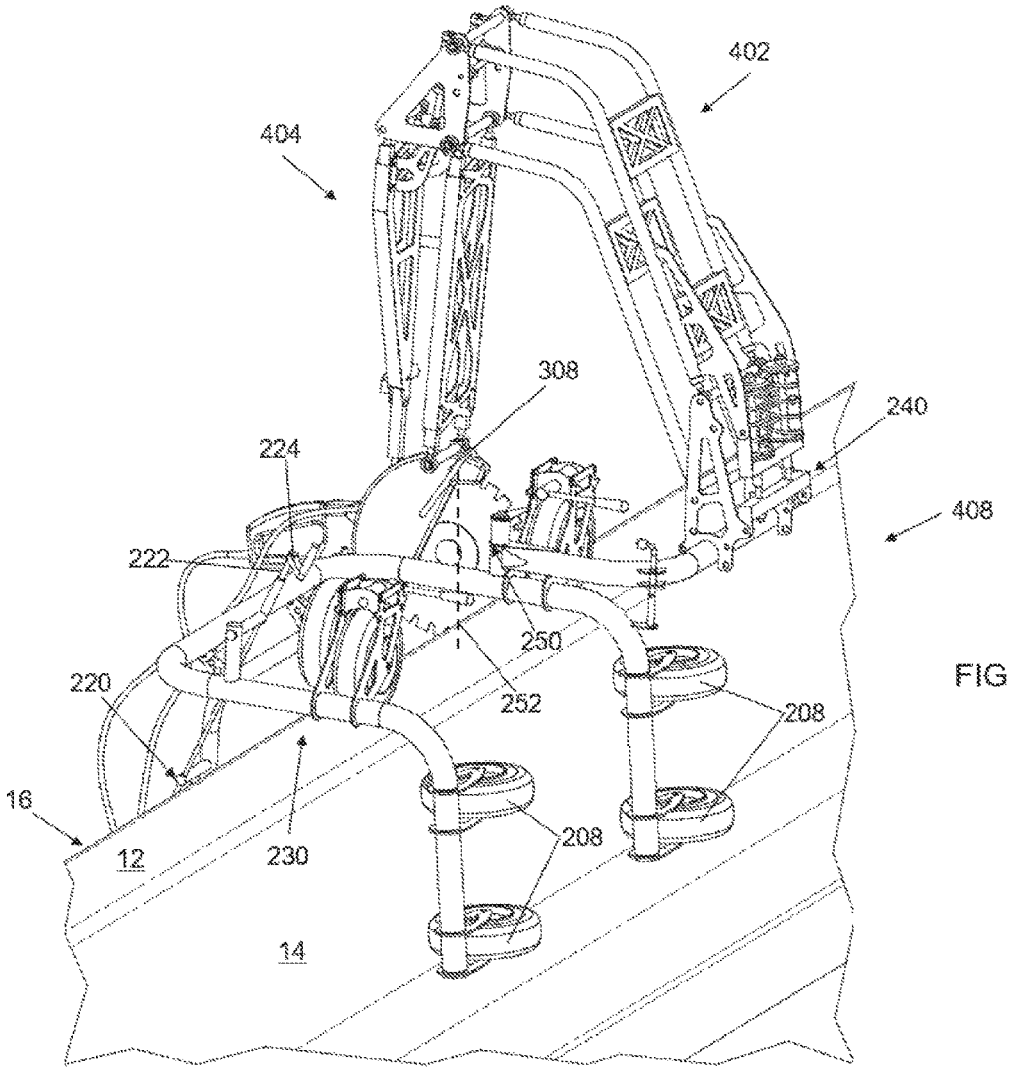
FIG. 4 is another perspective of the system of FIG. 1, shown in a second configuration.

Referring now to FIGS. 1, 2, 4 and 6, the linkage assembly 400 can be positioned or configured between a first configuration 406, in which the circular saw 500 faces the first lateral wall 14 of the barrier 10, as in FIGS. 1 and 2, and a second configuration 408, in which the circular saw 500 faces the second lateral wall 16, as in FIGS. 4 and 6. Preferably, as per the illustrated embodiment, the linkage assembly can be moved between the first and second configurations 406, 408 by pivoting the linkage assembly 400 relative the barrier mounting frame 200. Still preferably, pivoting the assembly 400 between the first and second configurations 406, 408 is done about a pivot 250 having a vertical axis 252.

Still referring to FIGS. 1, 2, 4 and 6, the barrier mounting frame 200 preferably comprises a lower barrier frame section 230, that rests on the barrier 10—via the free wheels, and an upper barrier frame section 240, which is pivotally connected to the lower frame section 230. The lower and upper sections 230, 240 are preferably connected via the vertical axis 252 of the pivot 250. In the present case, the lower and upper barrier frame sections 230, 240 both comprise tubular framing elements, some of which are aligned when in the first configuration, as best shown in FIG. 1. The linkage assembly 400 being attached to the upper frame section 240, the assembly 400 moves with the upper frame section 240 when the upper frame section 240 is pivoted relative to the lower frame section 230. While a pivoting motion of the lower and upper sections 230, 240 provides a lean and simple reconfiguration mechanism to change the orientation of the circular saw relative to the faces 14, 16 of the barrier 10, other reconfiguring mechanisms are possible. For example, in other embodiments of the system, it can be considered to provide a pivoting mechanism that would allow the saw to pivot relative to the saw support 430. In the present case, a pivot 250 is provided on one of the framing elements 212*a* of the top section of the barrier mounting frame 200, but it can be positioned elsewhere on the system 100. A locking system 410 can be provided to lock the lower and upper frame sections 230, 240 relative to one another, when they are placed in the first or second configurations.

Figure 5:
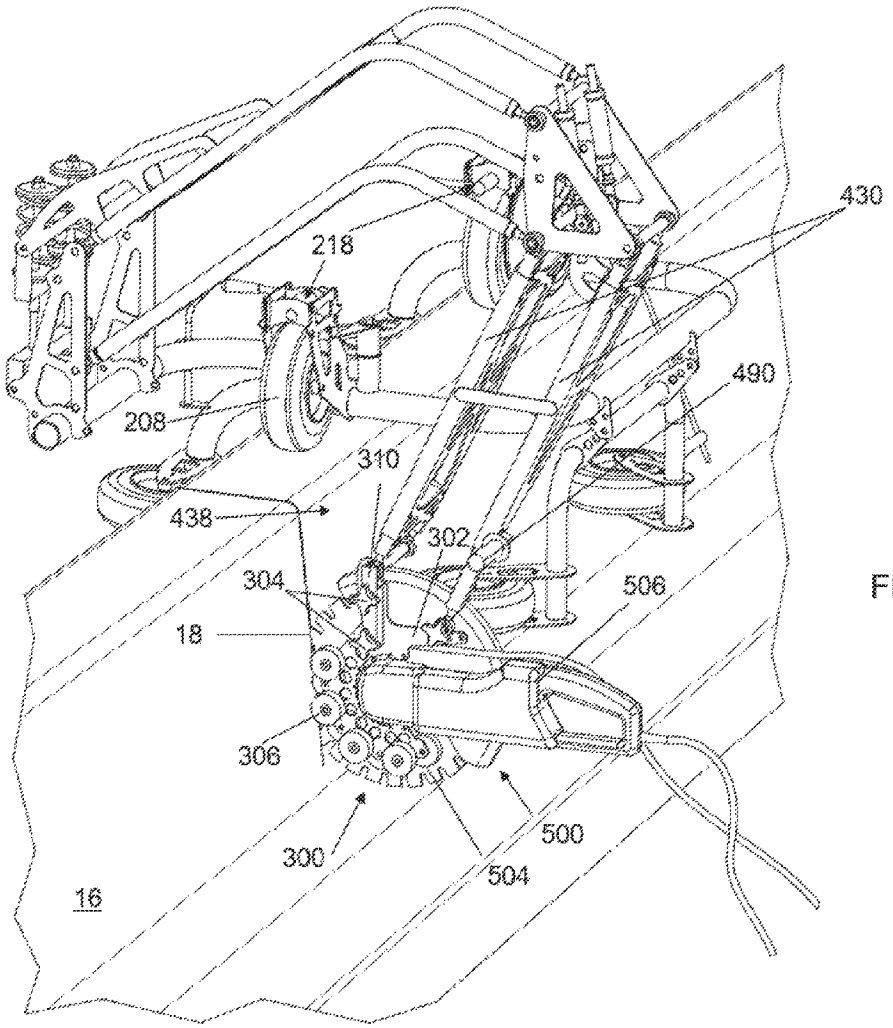
FIG. 5 is a partial view of the system of FIG. 1, shown in use.

Referring now to FIG. 5, a worker is shown operating the system 100. The system is configured in the second configuration, with the circular saw 500 facing the second lateral face 16 of the barrier. The linkage assembly 400 is in a lowered and contracted position. The worker is cutting a vertical portion of a control joint 18. The saw attachment 300 includes an attachment plate or frame 302, which preferably has an arc-shape, to conform to the shape of the saw. Attachment screws 304 secure the blade guard and/or protective housing of the circular saw to the attachment plate/frame 302 and allow adjusting the orientation of the saw relative to the attachment 300. In the illustrated embodiment, the saw attachment 300 is pivotally connected to the saw support 430, about pivot points 310 (one is hidden in FIG. 5), and the saw 500 can tilt slightly about the pivot point axes. The saw attachment 300 is also provided with wheel guides 306, that limit the depth of the transverse control joint 18. The wheel guides are thus preferably positioned at a predetermined distance from the periphery of the saw blade 504. Control joints do not need to transverse completely the barrier and are typically between 1 or 2 inches deep. The system 100 also preferably includes a water inlet 308, connected to a water hose. In the illustrated embodiment, the water inlet 308 is provided on the saw attachment 300, however in other embodiments, it is possible to provide the inlet 308 elsewhere, such as on the blade guard and/or saw housing. A saw support handle 490 can be provided toward the lower support end, to provide the worker with a grip in addition to the one of the circular saw 500, when manipulating the system to create the control joints 18. As can appreciated, the system 100 can be manually transported along the barrier, by a single worker and the circular saw 500 can be manually operated to create the joints. The system is light enough to be mounted on the barriers by only one or two workers, and preferably does not require any electrical input to be operated, other than for the circular saw.

Optionally, the system 100 can include a control handle to operate the saw from only one side of the barrier, without needing the worker to be positioned on the same side as the one on which the control joint must be made. In some cases, one of the lateral sides of the barrier is right above a cliff or above a vertical wall, making impossible for a worker to work on both sides of the barrier. Yet in other cases, the height of the barrier prevents workers from working on both sides of the barrier. In such cases, the control handle or guide can be connected to the saw support 430 and/or saw attachment 300, allowing a workman to control the motion of the circular saw 500 without needing to be located on the same side as the saw.

Referring to FIGS. 1 to 6, the method of sawing control joints using the system described above will be explained. Initially, the system 100 must be mounted on the barrier. The system can be mounted by one or two workers, as it can be dissembled in multiple sections: the barrier mounting frame weights about 45 kg, the linkage assembly 400 weighs about 40 kg, and the circular saw, about 15 kg. Thus the system without the saw installed weighs less than 100 kg, therefore it is possible for a single worker to install and operate it. In use, the barrier mounting frame 200 rests on the barrier 10, against the top, the first and the second lateral faces 12, 14, 16. The free wheels that are provided on framing elements of the barrier mounting frame 200, allow the system to slide along the barrier. The distance between the innermost surface of the wheels on the first and second lateral sections of the frame 200 is adjusted according to the width of the barrier. Wth the illustrated system, adjusting the distance between the wheels is made by rotating the rod 222 via the handle 224, which is turn rotates the lateral framing elements on which some of the free wheels are attached. Once the lateral sections of the barrier mounting frame 200 are tightened against the lateral faces of the barrier, clamping the barrier, the adjustment mechanism is locked in place to maintain the barrier clasped between the sections 204, 206, while still allowing the system 100 to be rolled along the barrier. When positioned at the desired location, the brake 218 can be actuated to prevent the top wheels from moving. At this point the system 100 is in the first configuration, such as in FIGS. 1, 2 and 3. A worker can then power the electrical saw 500 and open the water inlet 308, to prevent the blade from overheating and/or generating to much dust. The worker can grab the saw and/or saw support handle to move the circular saw vertically along the first lateral side 14 of the barrier, to create a first vertical portion of the transverse joint. The wheel guides prevent the saw blade from entering too deep in the barrier. The worker can also move the circular saw horizontally, on the top face of the barrier, to create a horizontal portion of the control joint.

At this point, the worker stops the circular saw and water inlet, and reconfigures the system from the first configuration 406 to the second configuration 408. More specifically, the worker places the first and second linkage sub-assemblies in the raised and contracted positions. The worker then unlocks the upper frame section 240 from the lower frame section 230, and pivots the upper frame section 240 about the pivot 250, so that the lower and upper frame sections are not longer aligned, but are positioned side by side. The worker then relocks the upper and lower frame sections relative to one another, such that they are maintained in the second configuration, as shown in FIGS. 4,5 and 6. Since the linkage assembly 400 is connected to the upper frame section 240, the saw 500 is no longer aligned with the first portions of the control joint. The system is thus rolled along the barrier, until the saw is once again aligned with the initial portion of the control joint. The wheels are blocked again, and the worker moves the circular saw 500 to saw the remaining vertical portion of the control joint, along the other lateral side 16 of the barrier, such that the first and second vertical segments are aligned. Of course, the steps described above do not necessarily need to be conducted in this order. For example, the system can be move before being reconfigured, and the top portion of the joint can be made while the system is in second configuration, rather than in the first.

As can be appreciated, the system provides a safe way of sawing control joints in concrete barriers. The system 100 allows creating vertical and horizontal portions of the joint aligned with one another, with the portion of the joint in the top face of the barrier being orthogonal to the top surface. The system can be operated mechanically, in most cases by a single worker, and the linkage assembly is simple yet versatile enough not only to support the weight of the circular saw, but also to guide the motion of the circular saw transversally relative to the barrier, without requiring too much effort from the worker. The system can typically be installed, configured and operated by a single worker, because of its light yet robust construction. The system can be used on different types of barriers, having different heights and widths. The system can be moved along the barrier without requiring any electrical motors, and the circular saw can be manually moved relative the barrier, without any external motor. The only power required is to rotate the blade of the circular saw. The dampening mechanism, which preferably includes shock absorbers, also ensures a safe use of the system, in providing an anti-kickback system for the circular saw.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A system for sawing a control joint in a concrete barrier, the barrier comprising a top face and opposed first and second lateral faces, the system comprising:

a barrier mounting frame slidably mountable about the barrier, on the top face and the first and the second lateral faces of the barrier, the barrier mounting frame comprising first and second lateral sections for resting against the first and second lateral faces of the barrier, and the barrier mounting frame comprising a top section provided between the first and second lateral sections, for resting on the top face of the barrier, each of said sections comprising at least one free wheel allowing the barrier mounting frame to roll along the barrier;

a saw attachment comprising a circular saw attached thereto, the circular saw being manually operable; and a linkage assembly connecting the barrier mounting frame to the saw attachment, the linkage assembly allowing the circular saw to manually move upwardly or downwardly, along the first or second lateral faces of the barrier, and towards or away from the barrier, when in use, to create the control joint transversally along the top face and the first and second lateral faces of the barrier.

2. The system according to claim 1, wherein the saw attachment comprises wheel guides to limit the depth of the transversal joint cut into the barrier.

3. The system according to claim 1, wherein the first lateral section, the second lateral section, and the top section of the barrier mounting frame each comprises two framing elements spaced apart, each framing element comprising at least one of said free wheels.

4. The system according to claim 1, comprising at least one manually operable brake to block at least one of the free wheels and prevent the barrier mounting frame from sliding along the barrier.

5. The system according to claim 1, wherein the barrier mounting frame comprises an adjustment mechanism to adjust a spacing between the first and second lateral sections of the barrier mounting frame according to a width of the barrier.

6. The system according to claim 5, wherein the adjustment mechanism comprises a rod connected to one of the framing elements of the first or second lateral sections, the rod being operatively connected to one of the wheels of said one of the first or second lateral sections, whereby rotation of the rod moves said one wheel toward or away from the first or second lateral faces of the barrier, when the system is mounted on the barrier.

7. The system according to claim 1, wherein the linkage assembly comprises first and second linkage sub-assemblies, the first linkage sub-assembly being pivotally connected to the barrier mounting frame, to raise or lower the circular saw relative to the barrier, the second linkage sub-assembly being pivotally connected to the first linkage sub-assembly, to move the circular saw toward or away from the barrier, when in use.

8. The system according to claim 1, wherein the linkage assembly comprises:

a first four-bar linkage comprising a lower end and an upper end, the lower end pivotally coupled to the barrier mounting frame; and a second four-bar linkage comprising a lower end and an upper end, the upper end of the second four-bar linkage being operatively coupled to the upper end to the first four-bar linkage, the lower end of the second four-bar linkage being operatively coupled to the saw attachment.

9. The system according to claim 8, wherein the first four-bar linkage comprises at least one upper link and at least one lower link, both pivotally connected to a fixed link at the lower end and to a floating link at the upper end, and wherein the second four-bar linkage comprises at least one inner link and at least one outer link, both pivotally connected to the floating link at the upper end and to the saw attachment at the lower end.

10. The system according to claim 1, wherein in use, when the barrier mounting frame is mounted about the barrier, the linkage assembly is configurable between a first and second configuration, wherein in the first configuration, the circular saw faces the first lateral face of the barrier, and in the second configuration, the circular saw faces the second lateral face of the barrier.

11. The system according to claim 1, comprising a lower barrier frame section for resting on the barrier when in use, and an upper frame section pivotally connected to the lower frame section about a vertical axis, the linkage assembly being movable with the upper frame section when the upper frame section is pivoted relative to the lower frame section.

12. The system according to claim 1, wherein the linkage assembly comprises a boom that comprises a lower boom end and an upper boom end, the lower boom end being pivotable relative to the barrier mounting frame, the boom being movable between a raised position and a lowered position when in use.

13. The system according to claim 12, wherein the linkage assembly comprises a saw support comprising an upper support end and a lower support end, the upper support end being pivotable relative to the upper boom end, the saw attachment being connected at the lower support end, the saw support being movable between contracted and retracted positions.

14. The system according to claim 12, comprising a biasing mechanism biasing the boom upwardly.

15. The system according to claim 14, wherein the biasing mechanism comprises at least one of a compression spring or a pneumatic cylinder operatively connected to the boom and to the barrier mounting frame.

16. A system for creating crack control joints in a concrete barrier, the barrier comprising a top face and opposed first and second lateral faces, the system comprising:

a barrier mounting frame mountable about the barrier, on the top and lateral faces of the barrier, the barrier mounting frame comprising wheels to move the system along the barrier;

a first linkage sub-assembly pivotable relative to the barrier mounting frame about a first axis, the first linkage assembly being movable between raised and lowered positions;

a second linkage sub-assembly pivotable relative to the first linkage sub-assembly about a second axis parallel to the first axis, and being movable between contracted and retracted positions; and a saw attachment provided at a lower end of the second linkage assembly, the saw attachment comprising a circular saw attachable thereto, to saw the crack control joints transversally on the top and lateral faces of the concrete barrier.

17. The system according to claim 16, wherein the first linkage sub-assembly is pivotable relative to the barrier mounting frame about a vertical axis, for configuring the system, when the system is mounted on the barrier, between a first configuration in which the saw attachment faces the first lateral face of the barrier, and a second configuration in which the saw attachment faces the second lateral face of the barrier.

18. The system according to claim 16, comprising at least one shock absorber disposed between the first and the second linkage sub-assemblies, to prevent kickback of the circular saw when operated.

19. A system for sawing a control joint in a concrete barrier, the barrier comprising a top face and opposed first and second lateral faces, the system comprising:

a barrier mounting frame slidably mountable onto the barrier, on the top face and the first and second lateral faces of the barrier, the barrier mounting frame comprising a lower barrier frame section for resting on the barrier when in use, and the barrier mounting frame comprising an upper frame section pivotally connected to the lower frame section about a vertical axis, a saw attachment comprising a circular saw attached thereto, the circular saw being manually operable; and a linkage assembly connecting the barrier mounting frame to the saw attachment, the linkage assembly being movable with the upper frame section when the upper frame section is pivoted relative to the lower frame section, the linkage assembly allowing the circular saw to manually move upwardly or downwardly, relative to the ground, and towards or away from the barrier, when in use, to create the control joint transversally along the top face and the first and second lateral faces of the barrier.

20. A system for sawing a control joint in a concrete barrier, the barrier comprising a top face and opposed first and second lateral faces, the system comprising:

a barrier mounting frame slidably mountable about the barrier on the top face and the first and second lateral faces of the barrier, the barrier mounting frame comprising first and second lateral sections for resting against the first and second lateral faces of the barrier, and the barrier mounting frame comprising a top section provided between the first and second lateral sections, for resting on the top face of the barrier, each of said sections comprising at least one free wheel allowing the barrier mounting frame to roll along the barrier;

a saw attachment comprising a circular saw attached thereto, the circular saw being manually operable; and a linkage assembly connecting the barrier mounting frame to the saw attachment, the linkage assembly allowing to the circular saw to manually move upwardly or downwardly, relative to the ground, and towards or away from the barrier, when in use, to create the control joint transversally along the top face and the first and second lateral faces of the barrier, the linkage assembly comprising:

a boom comprising a lower boom end and an upper boom end, the lower boom end being pivotable relative to the barrier mounting frame, the boom being movable between a raised position and a lowered position when in use; and a saw support comprising an upper support end and a lower support end, the upper support end being pivotable relative to the upper boom end, the saw attachment being connected at the lower support end, the saw support being movable between contracted and retracted positions.

21. The system according to claim 20, comprising a dampening mechanism located between the boom and the saw support, to prevent kickback of the circular saw when operated, the dampening mechanism comprising at least one shock absorber.

22. The system according to claim 20, wherein the saw attachment is pivotally connected to the saw support.

* * * * *